United States Patent [19]

Taylor

[11] 4,069,744

[45] Jan. 24, 1978

[54] GAS METERING ORIFICE FOR DECREASING GAS CONSUMPTION OF PNEUMATIC ACTUATOR

[75] Inventor: Larry Gordon Taylor, Plano, Tex.

[73] Assignee: Texas Instruments Incorporated, Dallas, Tex.

[21] Appl. No.: 715,757

[22] Filed: Aug. 18, 1976

Related U.S. Application Data

[63] Continuation of Ser. No. 545,460, Jan. 30, 1975, abandoned.

[51] Int. Cl.[2] ..... F15B 15/17; F15B 13/044

[52] U.S. Cl. ..... 91/417 R; 91/459

[58] Field of Search ..... 91/417 R, 321, 335

[56] References Cited

U.S. PATENT DOCUMENTS

| | | | |
|---|---|---|---|
| 2,310,750 | 2/1943 | Schnell | 91/321 |
| 3,390,612 | 7/1968 | Wills | 91/417 R |
| 3,478,645 | 11/1969 | Canalizo | 91/335 |
| 3,521,535 | 7/1970 | Pelrich | 91/417 R |

*Primary Examiner*—Paul E. Maslousky

*Attorney, Agent, or Firm*—Alva H. Bandy; Rene' E. Grossman

[57] ABSTRACT

Disclosed is an improved double acting piston actuator proportionally controlled by a pulse duration modulated control valve having a gas metering orifice in the actuator gas supply line to decrease gas consumption. The orifice reduces gas pressure applied to the actuator in proportion to the rate of gas use. The actuator has maximum gas consumption at mid range where actual load is a minimum and minimum consumption at actuator extremes where the load is maximum. The orifice thus supplies maximum pressure only when needed and reduces pressure and consumption under no load conditions.

5 Claims, 3 Drawing Figures

GAS METERING ORIFICE FOR DECREASING GAS CONSUMPTION OF PNEUMATIC ACTUATOR

This is a continuation, of application Ser. No. 545,460, filed Jan. 30, 1975, now abandoned.

This invention relates to actuators and more particularly to a pneumatically operated actuator proportionally controlled by a pulse duration modulated valve.

The control surfaces or fins of guided missiles or other guided projectiles are moved by power amplifying actuating devices which convert low power electrical guidance commands into high power mechanical signals. A position control mechanism designed for such applications is disclosed in U.S. Pat. No. 3,521,535 issued to John A. Oelrich. As disclosed by Oelrich, a three-way control valve is time modulated to control the flow of high pressure gas from a gas supply to a double acting piston actuator to control the position of the piston. The three-way valve either supplies high pressure gas to the actuator control volume or vents the control volume to ambient pressure. The control volume typically acts on a large area face of the piston, while full supply pressure acts on a small area face having half the area of the large area face. The valve does not supply pressure in linear proportion to desired piston position but the same effect is achieved by modulating the valve at a frequency above the maximum response frequency of the piston. The center or null position of the actuator, where load torque is normally zero, is achieved by modulating the valve at a 50% duty cycle. At this null position equal quantities of supply gases are alternately supplied to and vented from the control volume to maintain an average pressure of half the supply pressure. The extreme actuator positions, where load torque is maximum, are achieved by leaving the valve in one of its two positions continuously. At either extreme position only the quantity of gas required to fully fill or vent the control volume one time is expended. Thus, it is seen that when the actuator is supplying the least force it uses the most supply gas and when it is supplying the most force it uses the least supply gas.

The operating time of a pneumatic actuator is determined by the quantity of gas available and the rate of gas consumption. The available gas supply is determined by the volume of a gas storage bottle and the pressure of the stored gas. The stored gas pressure is limited by the bottle strength which is proportional to bottle weight. In airborne systems both the space available and the allowable weight are limited so that operating time of an actuator usually may not be increased by increasing the gas supply. In some systems, where weight is not critical, gas supply has been increased by increasing the stored gas pressure. When pressure is increased above 6000 psi the desired gas, nitrogen, can no longer be used due to compressibility problems. Helium is typically substituted and gas leakage then becomes a problem.

Decreasing gas consumption also extends the operating time of an actuator. Consumption has been reduced by reducing control valve gas port sizes, but the actuator rate of travel is also limited by this approach. The rate of travel can be increased by decreasing the swept volume of the actuator, but this also reduces the stall force of the actuator. All the prior art methods of reducing gas consumption also result in some reduction of mechanical output.

Accordingly, an object of the present invention is to provide an improved double acting piston actuator proportionally controlled by a pulse duration modulated control valve.

Another object of the present invention is to provide a pneumatic actuator which consumes substantially less gas then prior art actuators having equivalent mechanical output.

The above and other objects are achieved by providing a pneumatic actuator controlled by a pulse duration modulated valve wherein a gas supply conduit from a gas storage bottle to the actuator contains a gas metering orifice. The orifice limits gas pressure supplied to the actuator in proportion to actuator gas use. At the actuator center position, where gas consumption is a maximum, but load is a minimum, the orifice reduces the gas pressure supplied to the actuator and thereby reduces consumption. At actuator positions near the limits of its movement less gas is consumed and the orifice has little effect on gas supply pressure. Thus, the orifice does not reduce the mechanical output of the actuator at the extremes of its movement where the load is a maximum. The orifice reduces the gas consumption of the actuator without reducing its mechanical capabilities.

Other objects, features and advantages of this invention will become better understood by reference to the following detailed description when read in conjunction with the accompanying drawings wherein.

Figure 1:
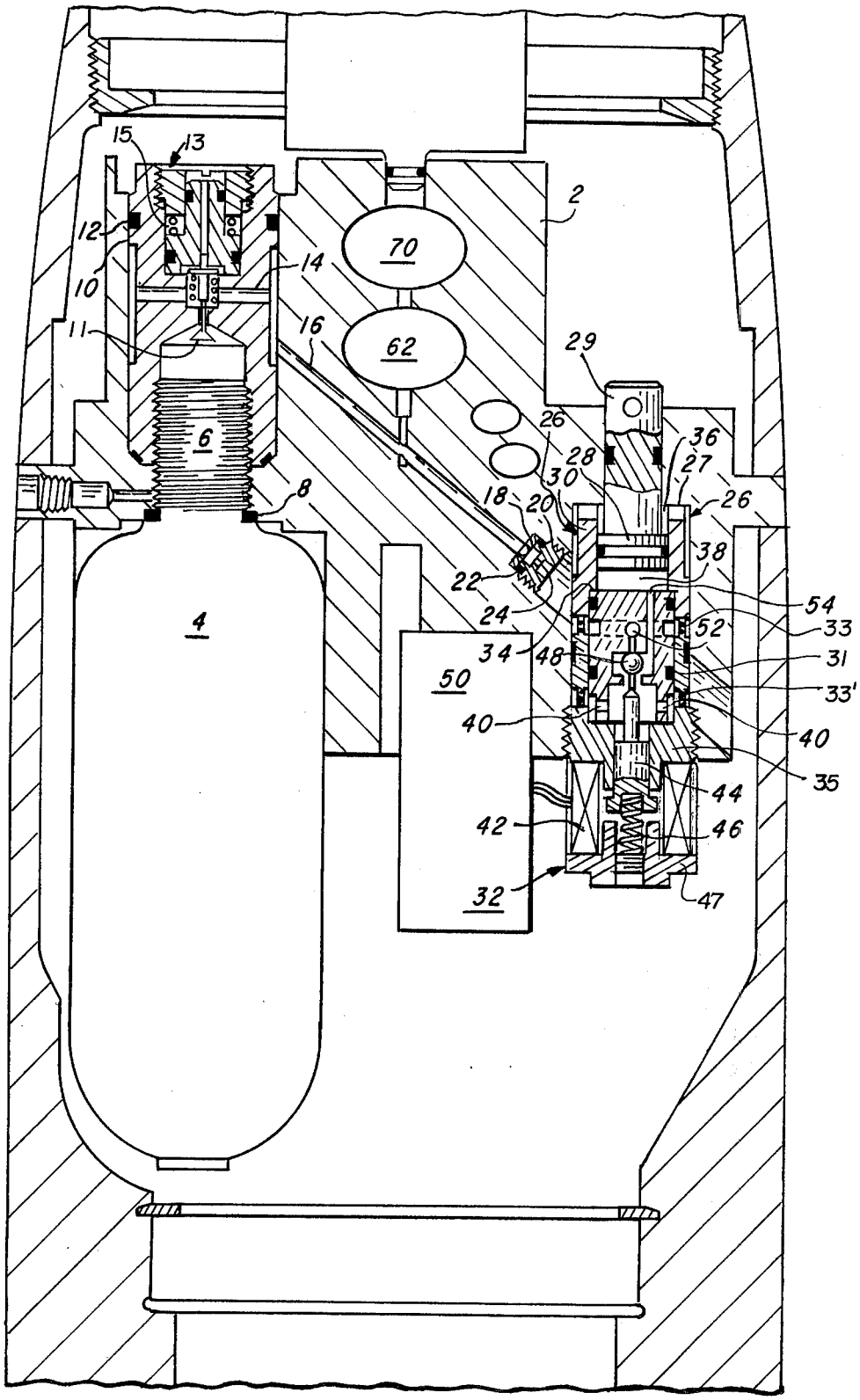
FIG. 1 is a cross sectional view of a guided projectile fin control section including a double acting piston actuator comprising the present invention.

Referring to FIG. 1 a housing 2 contains one end of a gas bottle 4, a pressure regulator 10, a filter 18, a retainer plug 20, a double acting piston 28, and one end of a valve assembly 32. The neck 6 of gas bottle 4 is held in housing 2 by being threaded into the pressure regulator 10. This one threaded joint holds both the regulator 10 and gas bottle 4 into housing 2. O-ring seals 8 and 12 seal the bottle 4 and regulator 10, respectively, in the housing 2. Gas from bottle 4 passes through regulator 10 and is provided at regulated pressure at outlet 14 which is in communication with a conduit 16 formed in housing 2. The regulator 10 includes a known adjustable metering valve 11 which is adjustable by means of a set screw 13 acting on spring 15 to open selectively the metering or poppet valve 11 to provide a desired operating pressure. Conduit 16 carries pressure regulated gas to filter 18 which is held in conduit 16 by a threaded retainer plug 20. Plug 20 is sealed in conduit 16 by O-ring 22 which prevents gas from flowing around plug 20. All gas flowing through conduit 16 must pass through an orifice 24 provided in the center of plug 20.

The orifice 24 in plug 20 is in communication with a chamber 26 in housing 2. Chamber 26 contains sleeves 30 and 31 in axial alignment. Sleeve 30 at its lower end has an outwardly extending flange portion and an interior shoulder. A valve assembly 32 which includes conduits 52 and 54, valve ball 48, coil 42, armature 44, spring 46, support member 35 and cap 47 is attached to housing 2 with its upper end abutting the shoulder in the lower end of the sleeve 30. The upper surface of the valve assembly 32, interior of sleeve 30 and portion of housing 2 form a cylinder for piston 28. Piston 28 divides the cylinder into upper and lower chambers 36 and 38. A stem 29 is attached to the upper surface of piston 28 and reduces the fluid responsive area of the upper piston surface as compared to the fluid responsive area of the lower piston surface for a purpose hereinafter described. The stem 29 slides within a passage provided therefore in housing 2. Sleeve 30 has a slotted and opposite its flanged end. This slotted end together with the exterior wall and upper side flange of sleeve 30 form a passage in continuous communication with the gas orifice 24 and upper chamber 36. Sleeve 31 has slotted vertically disposed flanges 33 and 33' at the ends. The flanges 33 and 33' are recessed from the edges of the sleeve's ends. The upper recessed slotted flange abuts the lower end of sleeve 30 and is retained in this position by the support member 35 if valve assembly 32. Support member 35 is threaded into corresponding threads of housing 2. This support member 35 abuts the lower slotted flange of sleeve 31. The upper and lower, slotted recessed flanges of sleeve 31 form passages. That is, the upper slotted flange forms a passage for connecting orifice 24 to conduit 52 and the lower slotted flange forms a passage for connecting 54 and 40 to atmosphere. Valve assembly 32 hereinafter described more fully, either conveys gas from orifice 24 into chamber 38 or vents chamber 38 to atmospheric pressure.

Within the valve assembly 32 are solenoid coil 42, an armature 44, a return spring 46, and a valve ball 48. The coil 42 is driven by an electrical signal from an electrical control section 50. When coil 42 is activated the solenoid armature 44 moves away from piston 28 compressing return spring 46 and allowing valve ball 48 to move away from a seat in passage 52 below piston 28 to a seat in a passage to exhaust vent 40 thereby closing the passage to the exhaust vent 40 and opening to inlet passage 52 to allow supply gas to flow through the valve into a passage 54. Passage 54 couples gas from the valve into the control volume chamber 38 which acts on the large area side of piston 28. When supply gas is thus coupled into the control volume 38 the pressures on both sides of piston 28 are the same and the greater force on the large area side causes the piston to move away from valve 32. When coil 42 is not activated, armature spring 46 forces the armature 44 and the valve ball 48 toward piston 28 closing off inlet conduit 52 and opening the passage to exhaust vent 40 to allow gas in conduit 54 to escape through exhaust vent 40. Thus, when the coil 42 is inactivated the high pressure gas in control volume 38 is vented to the atmosphere and the high pressure gas in volume 36 forces piston 28 toward valve 32. The mechanical motion of piston 28 is coupled to control fins 58 (FIGS. 2 & 3) by a bell crank 56 (FIGS. 2 & 3) connected to the stem 29 of piston 28.

The position of piston 28 (FIG. 1) is controlled by driving solenoid coil 42 with a time modulated electrical signal generated by the electrical control section 50 which may be, for example, the control system disclosed in the above referenced U.S. Pat. No. 3,521,535 issued to J. A. Oelrich. The time modulated electrical signal causes the valve ball 48 to move between its two seating positions at a fixed carrier frequency but with a varying duty cycle. The carrier frequency is typically chosen to be five to ten times the maximum response frequency of the piston 28. The maximum response frequency of the piston 28 is the maximum frequency at which the piston can travel between its extreme positions with all system loads applied. The maximum response frequency is typically 10 cycles per second and the carrier frequency is between 50 and 100 cycles per second. The mechanical inertia of piston 28 and fins 58 (FIG. 3), integrates the effect of the valve time modulation so that the activator responds as if it were driven by proportional pressure control.

When the piston is at its center position there is zero aerodynamic pressure on control fins 58 (FIG. 3) and for the piston to remain in this position the forces on opposite piston faces must be equal. Assuming an area ratio of 2:1 for the opposite faces of piston 28 the average gas pressure in chamber 38 should be exactly one half the gas pressure in chamber 36. This half pressure level in chamber 38 is accomplished by driving valve ball 48 at a 50% duty cycle. To move piston 28 to its fully retracted position, the pressure in chamber 38 must be a minimum. This minimum pressure condition is achieved by changing the time modulation of ball valve 48 so that it vents chamber 38 to ambient pressure essentially 100% of the time. To move piston 28 to its fully extended position, the pressure in chamber 38 must be maximum. This maximum pressure condition is accomplished by changing the time modulation of ball valve 48 so that fully supply pressure is applied to chamber 38 essentially 100% of the time. Intermediate piston positions are achieved by other percentages of pulse duration modulation between the two valve positions and piston inertia averages the effect of oscillating pressure applied to control volume 38.

Gas consumption is limited by gas metering orifice 24 which is formed in filter retaining plug 20. The preferred orifice 24 is cylindrical and its length is from 0.5 to 1.5 times its diameter. This orifice is produced by drilling the desired diameter hole in the plug 20. This type of orifice is preferred due to its ease of manufacture and reproducibility. The orifice 24 causes a drop in gas pressure supplied to chamber 26 which is proportional to the rate of gas flow through orifice 24. At either travel extreme of piston 28, gas flow through orifice 24 approaches zero and there is essentially no pressure drop across orifice 24. The orifice 24, therefore, does not reduce the maximum mechanical force which piston 28 can supply. At the center position of piston 28 when gas use is a maximum, orifice 24 causes a considerable drop in pressure supplied to chamber 26. The gas consumption at this center piston position is basically the result of alternately charging up the gas in chamber 38 to the pressure supplied to chamber 26 and then venting the gas in chamber 38 to atmosphere through exhaust port 40. Gas consumption is therefore proportional to gas pressure and is reduced by lowering the pressure. Since there is essentially no aerodynamic pressure on the control surfaces at their center position the reduction of gas pressure has no substantial effect on the slew rate of piston 28 about its center position. At piston positions intermediate the center and either extreme, the orifice 24 has proportionally less effect on the pressure supplied to chamber 26.

The double acting piston actuator of the preferred embodiment has a metering orifice diameter of 0.015 inch and consumes 1 $in^3$/sec of gas at a regulated pressure of 1100 psi to produce a nominal stall force of 320 pounds. Orifice length is nominally equal to the diameter, but variations in the range 0.5 to 1.5 times diameter have essentially no effect on gas consumption or performance. The actuator according to this embodiment uses gas at about half the rate of a prior art actuator having equivalent mechanical output. This savings in consumption allows a 22 $in^3$ bottle of nitrogen at 6000 psi to supply the actuator of the preferred embodiment for the same time period in which a 28 $in^3$ bottle of helium at 8000 psi supplies the mechanically equivalent prior art actuator. The bottle is not only smaller but is lighter due to the lower pressure requirement and in addition the leakage problems of helium are avoided.

Figure 2:
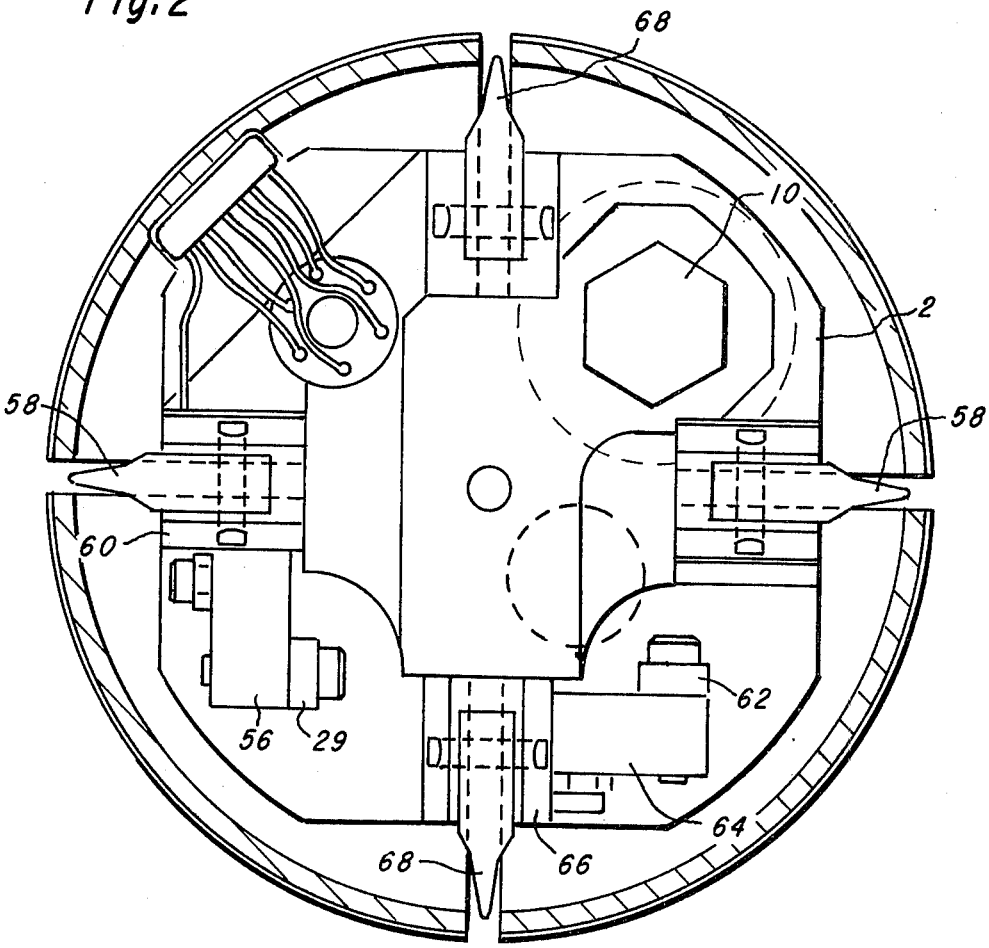
FIG. 2 is a top view of the fin control section of FIG. 1.

FIG. 2 is a top view of the fin control section comprising the present invention. Stem 29 of piston 28 (FIG. 1) is connected to bell crank 56 of a shaft 60. Shaft 60 passes through an opening 62 (FIG. 1) in housing 2 and has a control fin 58 attached to each end. The fins 58 are shown in a retracted position which allows the guided projectile to be launched from an artillery piece.

A second actuator identical to that described above drives a second set of fins 68 positioned at a right angle to fins 58. The second actuator has a piston stem 63 coupled by a bell crank 64 to a shaft 66. Shaft 66 passes through an opening 70 (FIG. 1) in housing 2 and has a control fin 68 attached to each end.

Figure 3:
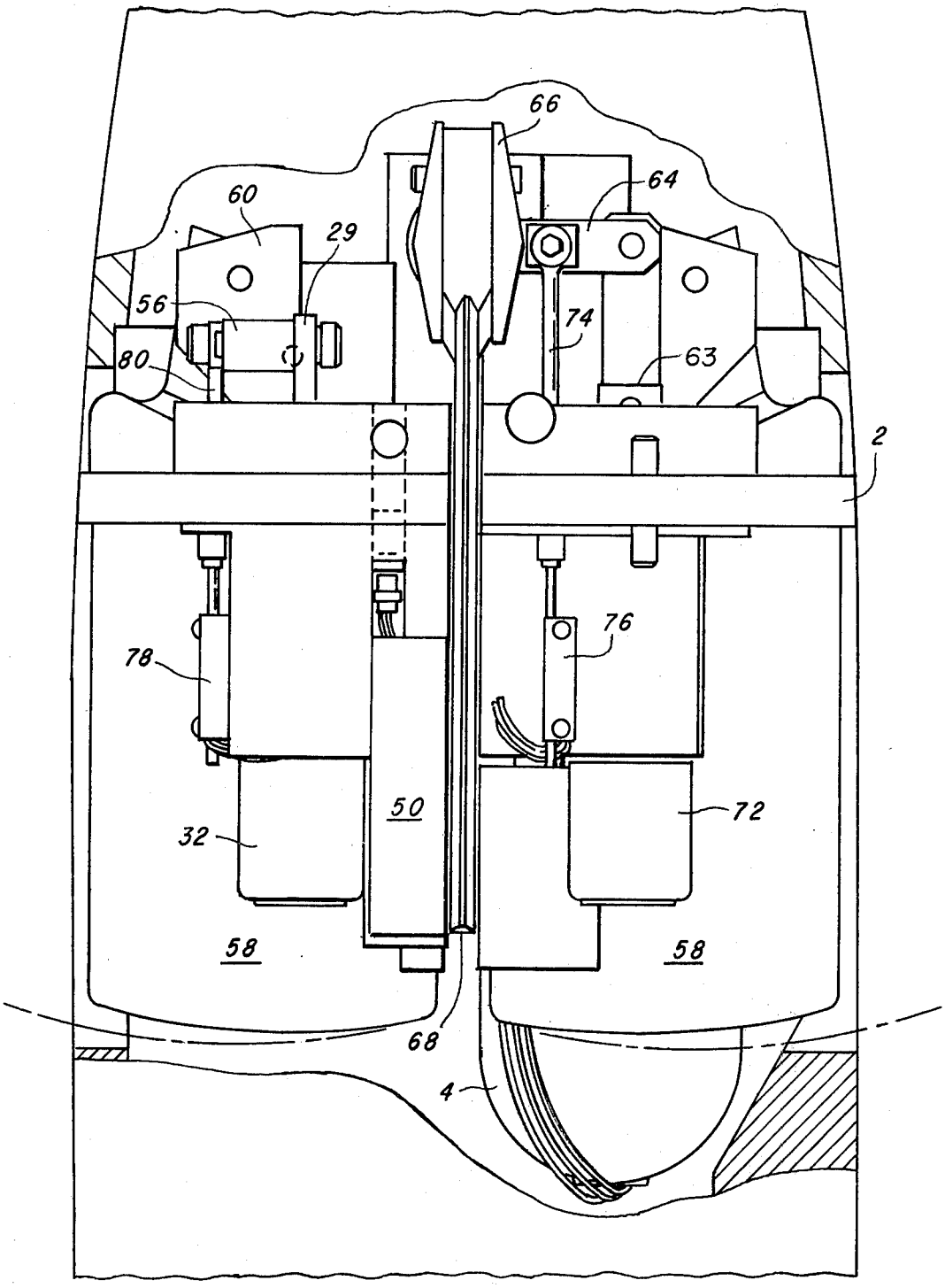
FIG. 3 is a side view of the fin control section of FIG. 1.

FIG. 3 is a side view of the control section and further illustrates the components shown in FIGS. 1 & 2. A control valve 72 which controls the second actuator and is identical to control valve in valve housing 32 is also shown. A position detector for the second actuator is also illustrated. This detector includes a sliding contact potentiometer 76 coupled by link pin 74 to bellcrank 64. The potentiometer is electrically connected to electronics package 50. A potentiometer 78 and link pin 80 are also provided for the first actuator.

Although the present invention has been shown and illustrated in terms of specific apparatus, it will be apparent that changes or modifications can be made without departing from the spirit and scope of the invention as defined by the appended claims.

What is claimed is:

1. A guidance control surface pneumatically operated actuator for guided missiles or the like comprising:

a. a pressurized source of compressible fluid;

b. a pressure regulator connected to the pressurized source for metering the compressed fluid at a desired pressure;

c. a conduit in communication with the pressure regulator;

d. a restriction means in said conduit for restricting the flow of fluid through the conduit;

e. a first and second chamber means including a first chamber in continuous communication with the conduit for receiving fluid from the restriction means continuously at a pressure reduced proportionally to the rate of gas flow through the restriction means, a second chamber capable of communicating with the restriction means, and a piston separating the first chamber from the second chamber, said piston having opposing sides forming two fluid responsive areas and a stem means attached to one of the opposing sides of the piston, the stem extending upwardly through the first chamber and reducing the fluid responsive area of said one side with respect to that of the opposing side of the piston;

f. a guidance control means connected to the piston stem means for actuation in response to piston movement;

g. a vent passage capable of communicating with the second chamber;

h. a valve means including a ball member connected between the restriction means and the second chamber and between the second chamber and the vent passage, said valve operative to shut off the emission of fluid to the second chamber while venting the second chamber and closing the vent passage while admitting fluid to the second chamber; and i. a valve control means including a spring biased, solenoid operated valve for selectively driving the valve whereby the piston is capable of being centered, extended and retracted with minimum gas consumption.

2. A guidance control surface pneumatically operated actuator according to claim 1 wherein said guidance control means connected to the stem means includes a shaft having a bell crank attached between its ends and control fins attached to the ends of the shaft.

3. A guidance control surface pneumatically operated actuator according to claim 1 wherein the valve control means includes a valve time modulated electrical control coupled to the solenoid actuated valve actuator for actuating the valve at a carrier frequency substantially above the response frequency of the piston.

4. A guidance control surface pneumatically operated actuator according to claim 1 wherein said pressurized source of compressible fluid is a bottle of compressed gas.

5. A guidance control surface pneumatically operated actuator according to claim 1 wherein said conduit restriction means for restricting the path of fluid flow in said conduit is formed in a conduit restricting plug.

* * * * *